US005278370A

United States Patent [19]

Miyata et al.

[11] Patent Number: 5,278,370

[45] Date of Patent: Jan. 11, 1994

[54] PUSH SWITCH

[75] Inventors: Muneyoshi Miyata; Nobuji Hasegawa; Satoshi Myojin, all of Tokyo, Japan

[73] Assignee: Mitsuku Denshi Kogyo Kabushiki Kaisha, Tokyo, Japan

[21] Appl. No.: 912,721

[22] Filed: Jul. 13, 1992

[30] Foreign Application Priority Data

Jul. 13, 1991 [JP] Japan ..... 3-198492
Oct. 14, 1991 [JP] Japan ..... 3-293644
Oct. 14, 1991 [JP] Japan ..... 3-293645

[51] Int. Cl.[5] ..... H01H 1/22

[52] U.S. Cl. ..... 200/244; 200/532; 200/562; 200/278

[58] Field of Search ..... 200/532, 535, 546, 557, 200/562, 553, 241, 244, 278

[56] References Cited

U.S. PATENT DOCUMENTS 2,061,391 11/1936 Tamsitt ..... 200/562
2,783,317 2/1957 Eckles ..... 200/553
3,250,882 5/1966 Campbell et al. ..... 200/241
4,052,579 10/1977 Arthur ..... 200/535
4,095,074 6/1978 Lockard ..... 200/244

*Primary Examiner*—Renee S. Luebke
*Attorney, Agent, or Firm*—Oblon, Spivak, McClelland, Maier & Neustadt

[57] ABSTRACT

A push switch includes a sideway U-shaped spring element positioned in a recess of a holder which is precision-formed of plastic resin by molding while keeping upper and lower sections of the U-shaped spring element compressed. The lower section of the spring element being divided into an upper contact portion and a lower contact portion having a length larger than the upper contact portion. The contact spring element is then housed in a casing provided with fixed contacts. The contact spring element being pivotally supported though a support shaft in the casing while contacting the lower contact portion with a first fixed contact and striking an upper plate of the holder against a stopper to stop upward pivotal movement of the holder due to the restoring force of the spring element.

6 Claims, 6 Drawing Sheets

PUSH SWITCH

BACKGROUND OF THE INVENTION

This invention relates to a push switch in which pressing and releasing of a pressing element causes operation of contacts or turning-on and -off of the switch to be carried out, and more particularly to a small-sized or down-sized push switch formed into dimensions as small as, for example, 4 mm in length, 8 mm in width and 6 mm in height and housed in an insulating casing.

A push switch is generally adapted to change over an electric circuit by the pressing and releasing of a pressing element and is widely used for electronic appliances associated with an FD, a DTA and the like. Unfortunately, the conventional push switch fails to satisfactorily exhibit both economical efficiency and switching performance. More particularly, a push switch exhibiting good economical efficiency is deteriorated in durability and/or switching performance, whereas that exhibiting good durability is expensive. Thus, it would be highly desirable to develop a push switch which is decreased in manufacturing cost and exhibits satisfactory durability and switching performance.

The push switch is required to be miniaturized as described above, therefore, a space required for the switching operation or a distance between a movable contact side and a fixed contact side is set to be 1 mm or less, for example, about 0.5 mm. For this reason, it is required to restrict variation of the dimension to a degree as low as about 0.2 mm. Nevertheless, the conventional push switch is provided on a movable side thereof with a spring member as bent such which is a leaf spring, a wire spring or the like irrespective of quality of the push switch, to thereby be widely varied in quality depending on the spring member and substantially fail to satisfy the above-described dimensional requirements.

SUMMARY OF THE INVENTION

The present invention has been made in view of the foregoing disadvantage of the prior art.

Accordingly, it is an object of the present invention to provide a push switch which is capable of being substantially down-sized.

It is another object of the present invention to provide a push switch which is capable of being significantly decreased in manufacturing cost.

It is a further object of the present invention to provide a push switch which is capable of eliminating a variation in quality depending on the push switch.

It is still another object of the present invention to provide a push switch which is capable of exhibiting serviceability sufficient to bear switching operation at a high frequency for a long period of time.

It is yet another object of the present invention to provide a push switch which is capable of exhibiting good switching performance.

In accordance with the present invention, a push switch is provided. The push switch comprises a sideway U-shaped spring element including an upper section, an inflected section and a lower section. The lower section is divided into an upper contact portion and a lower contact portion having a length larger than the upper contact portion. The push switch also includes a holder including an upper plate, a sideway U-shaped section and a lower plate and provided at a center thereof with a support shaft. The upper plate is provided on a distal end thereof with a pressing means which functions to pressedly pivotally move the holder about the support shaft when force is applied thereto. The upper plate, sideway U-shaped section and lower plate are formed on an inner surface thereof with a sideway U-shaped fit groove or recess so as to extend around the support shaft. The sideway U-shaped spring element is fitted in the fit recess of the holder while inwardly forcing the upper section and lower section (upper and lower contact portions) of the spring element, resulting in the holder and sideway U-shaped spring element cooperating with each other to constitute a contact spring element. The contact spring element is pivotally supported through the support shaft on a casing while inflectedly pressedly contacting the lower contact portion with one fixed contact and striking the upper plate of the holder against a stopper to stop upward pivotal movement of the holder due to restoring force of the spring element. The upper contact portion is positioned at a predetermined distance above the other fixed contact.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a push switch according to the present invention will be described hereinafter with reference to the accompanying drawings.

Figure 1:
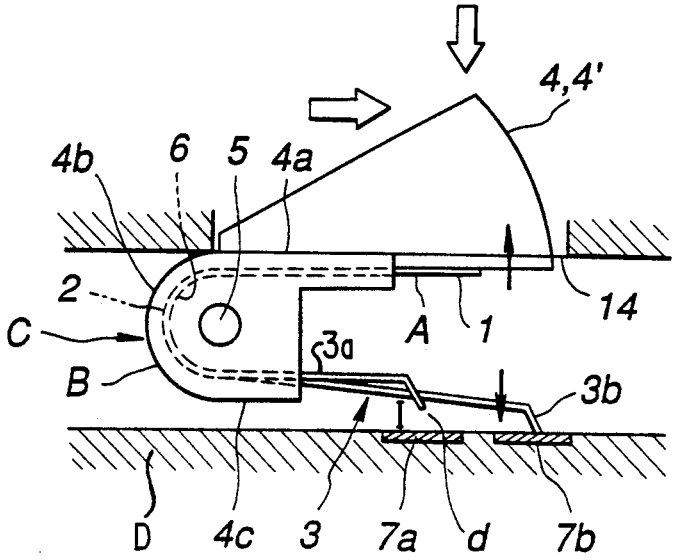
FIG. 1A is a vertical sectional front elevation view generally showing an embodiment of a push switch according to the present invention.
FIG. 1B is a vertical sectional front elevation view generally showing another embodiment of a push switch according to the present invention, in which a pressing means comprises a push button.
Figure 1:
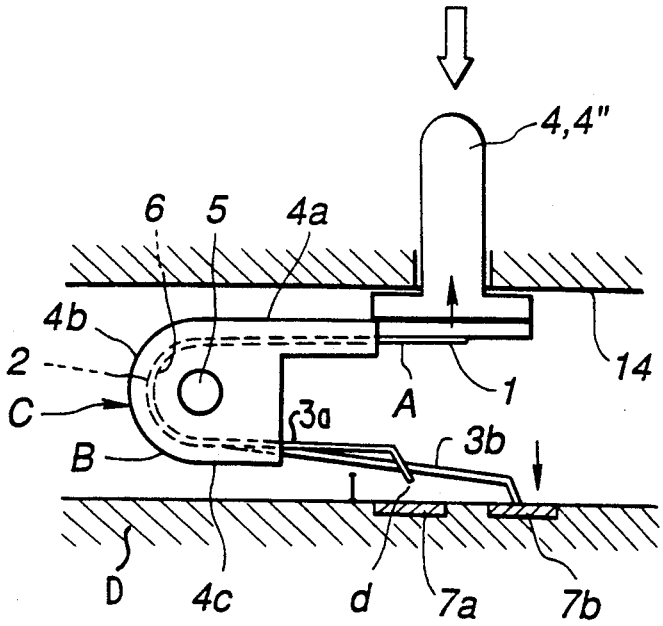
Figure 2:
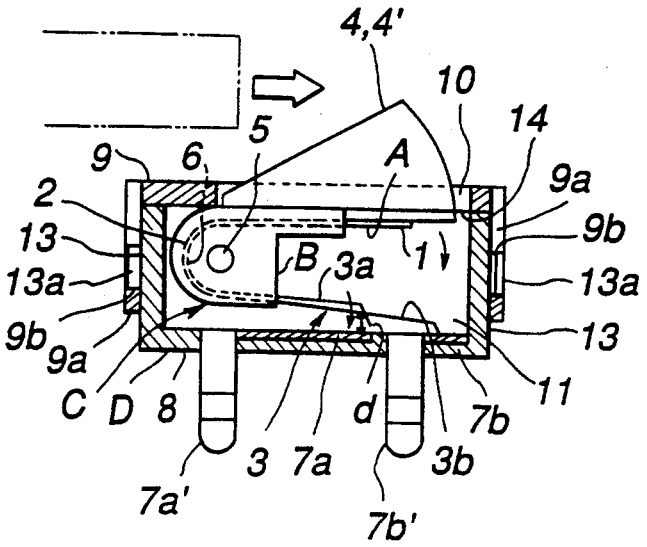
FIG. 2 is a vertical sectional view showing a further embodiment of a push switch according to the present invention, in which a contact spring element is housed in a casing.
Figure 3A:
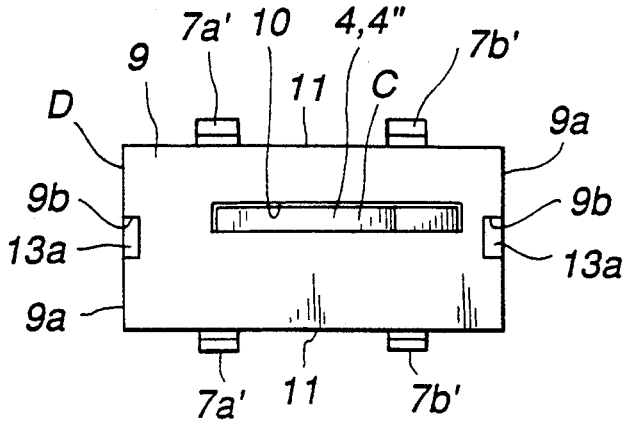
FIGS. 3A, 3B and 3C are plan view, a front elevation view and a right side view of the push switch shown in FIG. 2, respectively.
Figure 3C:
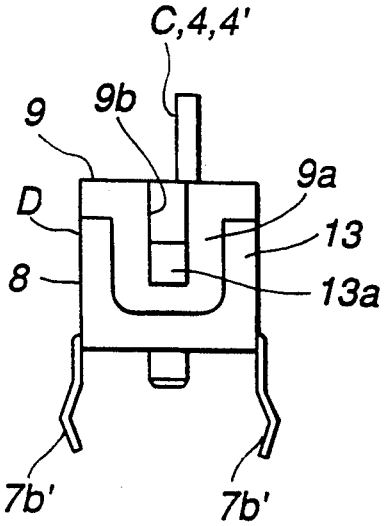
Figure 3B:
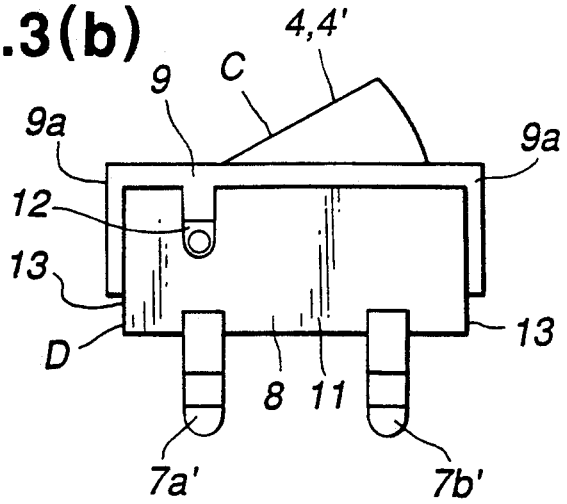
Figure 4:
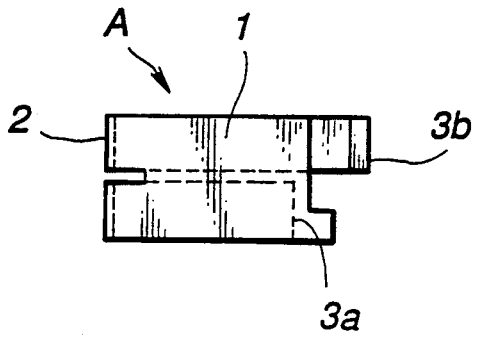
FIGS. 4A, 4B, 4C and 4D are a plan view, a front elevation view, a bottom view and a right side view showing a U-shaped spring element, respectively.
Figure 4:
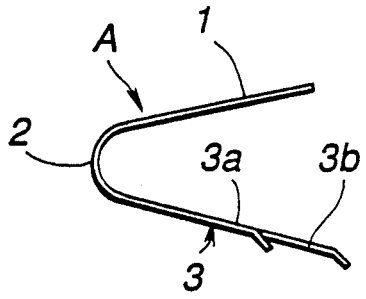
Figure 4:
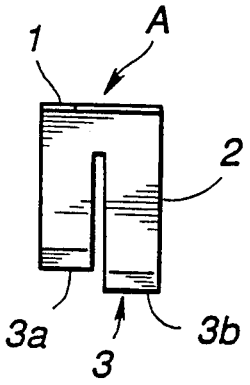
Figure 4:
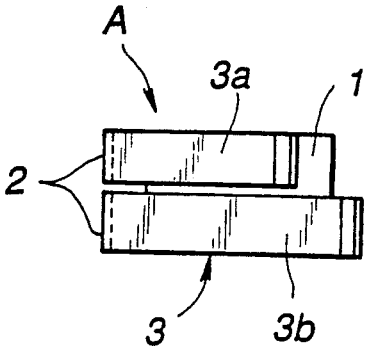
Figure 5:
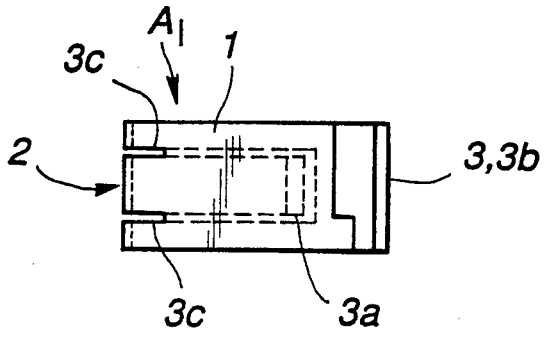
FIGS. 5A, 5B, 5C and 5D are a plan view, a front elevation view, a bottom view and a right side view showing a modification of the U-shaped spring element of FIGS. 4A to 4D, respectively.
Figure 5:
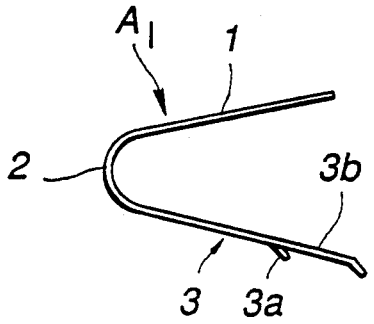
Figure 5:
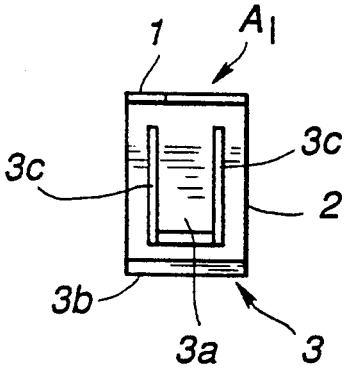
Figure 5:
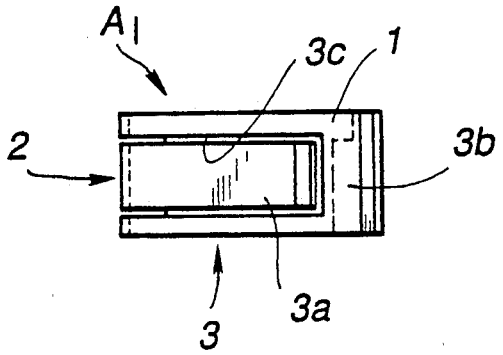
Figure 6:
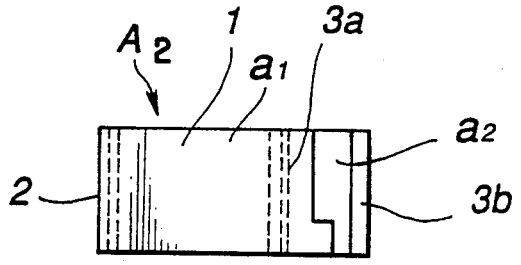
FIGS. 6A, 6B, 6C and 6D are bottom view, a front elevation view, a plan view and a right side view showing another modification of the U-shaped spring element of FIGS. 4A to 4D, respectively.
Figure 6:
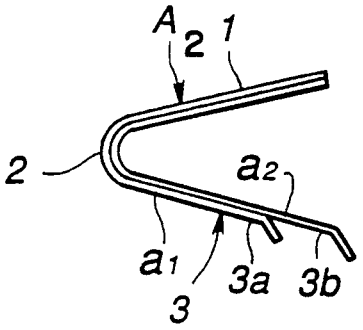
Figure 6:
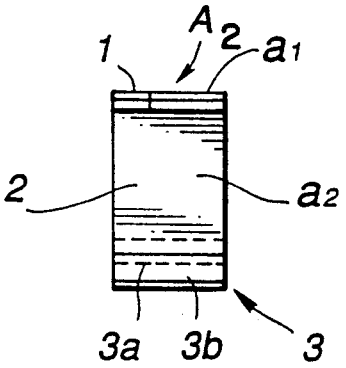
Figure 6:
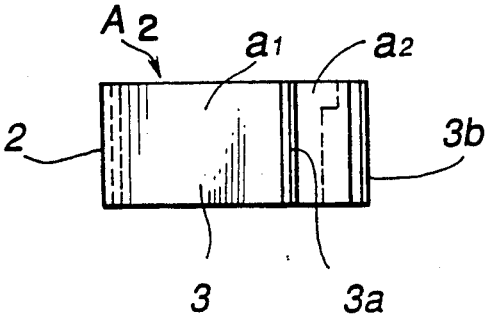
Figure 7A:
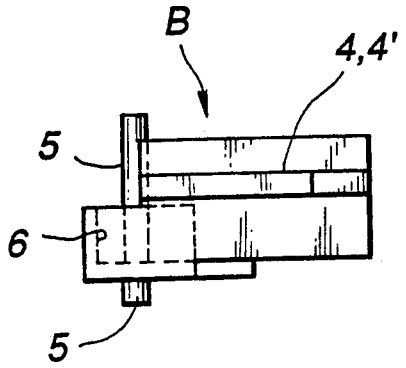
FIGS. 7A, 7B, 7C and 7D are a plan view, a front elevation view, a bottom view and a right side view each showing a holder, respectively.
Figure 7B:
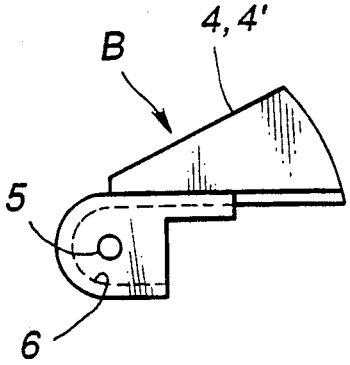
Figure 7D:
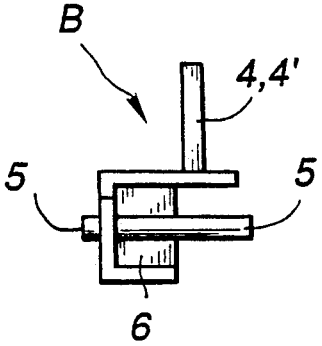
Figure 7C:
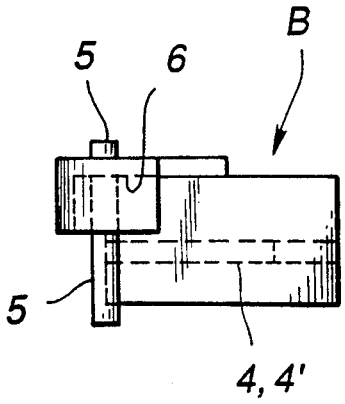

Referring first to FIG. 1 showing an embodiment of a push switch according to the present invention, a push switch of the illustrated embodiment includes a sideway U-shaped spring element A including an upper section 1, an inflected section 2 and a lower section 3, wherein the lower section 3 is divided into an upper contact portion 3a and a lower contact portion 3b having a length larger than the upper contact portion 3a.

The push switch includes a holder B including an upper plate 4a, a sideway U-shaped section 4b and a lower plate 4c and provided at a center thereof with a support shaft 5. The upper plate 4a is provided on a distal end thereof with a pressing means 4 which functions to pressedly pivotally move the holder B about the support shaft 5 when force is applied thereto. The upper plate 4a, sideway U-shaped section 4b and lower plate 4c are commonly formed on an inner surface thereof with a sideway U-shaped fit groove or recess 6 so as to extend around the support shaft 5. The sideway U-shaped spring element A is fitted in the fit recess 6 of the holder B while inwardly forcing the upper section 1 and lower section 3 (or upper and lower contact portions 3a and 3b) of the spring element A, resulting in the holder B and sideway U-shaped spring element A cooperating with each other to constitute a contact spring element C. The contact spring element C is pivotally supported through the support shaft 5 in a casing D while inflectedly pressedly contacting the lower contact portion 3b with a first or one fixed contact 7b and striking the upper plate 4a of the holder B against a stopper 14 to stop upward pivotal movement of the holder B due to restoring force of the spring element. The upper contact portion 3a is positioned at a predetermined distance above a second or the other fixed contact 7a.

The sideway U-shaped spring element A may be constructed in such a manner as shown in FIGS. 5A to 5D. More particularly, in a U-shaped spring element generally indicated at reference character $A_1$ in FIGS. 5A to 5D, a lower section 3 is formed with a U-shaped slit 3c, resulting in being provided at a central portion thereof with a strip-like upper contact section 3a.

Alternatively, it may be constructed as shown in FIGS. 6A to 6D. In a sideway U-shaped spring element $A_2$, a sideway U-shaped spring element member $a_1$ in which a distal end of a lower section 3 serves as an upper contact portion 3a and a sideway U-shaped spring element member $a_2$ which is formed into a length larger than the spring element member $a_1$ and of which a distal end of a lower section 3 serves as a lower contact portion 3b are fittedly superposed on each other so as to permit the upper contact portion 3a to be positioned above the lower contact portion 3b, resulting in the sideway U-shaped spring element $A_2$ being constructed.

The pressing means 4 provided on the distal end of the upper plate 4a of the holder B may take any suitable form so long as it functions to pressedly pivotally move the holder B about the support shaft 5 when pressing force is applied thereto. For example, it may comprise a pressing element 4' integrally provided on the distal end of the upper plate 4a so as to be upwardly projected therefrom, as shown in FIG. 1A. Alternatively, it may comprise a push button 411 separately provided on the distal end of the upper plate 4a so as to be upwardly projected therefrom, as shown in FIG. 1B.

Referring now to FIGS. 2 and 3A to 3C, another embodiment of a push switch according to the present invention is illustrated wherein a contact spring element C is arranged in a casing D formed into a small size. More particularly, the casing D includes a casing body 8 which is provided on an inner bottom surface thereof with fixed contacts 7a and 7b. The fixed contacts 7a and 7b have terminals 7a' and 7b' outwardly projected from the casing body 8, respectively. The casing D also includes a top plate 9, which is formed with a slit 10 through which a pressing element 4' is inserted. Further, the casing body 8 is provided on side plates 11 thereof opposite to each other with recesses 12 in which both ends of a support shaft 5 are fitted. The contact spring element C is arranged in the so-constructed casing D in such a manner that the support shaft 5 is born in the recesses 12. The pressing element 4' is upwardly projected from the slit 10, a lower contact portion 3b is pressedly contacted with the fixed contact 7b and the upper contact portion 3a is positioned at a predetermined distance d above the fixed contact 7a. Then, the top plate 9 is securely fixed on the casing D by securely fitting projections 13a formed on opposite side plates 3 of the casing D in holes 9b of downwardly extending plates 9a provided on opposite ends of the top plate 9. The top plate 9 thus fittedly mounted on the casing D acts at a rear surface thereof as a stopper 14 for receiving upward pivotal movement of a holder B due to pressed contacting of the lower contact portion 3b with the fixed contact 7b and preventing the contact spring element D from disconnecting from the casing D.

Now, the manner of operation of the push switch of the illustrated embodiment described above will be described hereinafter.

When pressing force is downwardly applied to the pressing element 4 of the contact spring element C housed in the casing D which is outwardly projected through the silt 10 of the top plate 9, the contact spring element is actuated in such a manner that the upper section 1 is compressed toward the lower section 3. In the illustrated embodiment, the contact spring element C is pivotally supported through the center of the inflected section 2 on the support shaft 5, so that the pressing force applied to the pressing element 4 acts to downwardly pivotally move the distal end or upper and lower contact portions 3a and 3b of the lower section 3. This causes the lower contact portion 3b inflectedly pressedly contacted with the fixed contact 7b to be further downward forced, so that the upper contact portion 3a may be lowered by the predetermined distance d, resulting in being pressedly contacted with the fixed contact 7a, leading to turning-on of the switch.

As described above, pressing force applied to the pressing element 4 acts to downwardly pivotally move the distal end of the lower section 3 to pressedly contact the upper contact portion with the fixed contact, so that the lower contact portion 3b and upper contact portion 3a may be slightly slid on the fixed contacts 7a and 7b while being kept pressedly contacted therewith, respectively.

Then, when the pressing force is released, the upper and lower sections 1 and 3 of the spring element are elastically returned to the original position, and the lower contact portion 3b of the lower section 3 is returned to the original position while being kept pressedly contacted with the fixed contact 7b, so that the upper contact portion 3a may be upwardly moved by the predetermined distance d, resulting in the switch being turned off.

As can be screen from the foregoing, in the push switch of the present invention, the contact spring element is formed by fitting the sideway U-shaped spring element in the recess of the holder precision-formed of plastic resin by molding while keeping the upper and lower sections compressed. Such construction effectively prevents deformation of the sideway U-shaped spring element because it is held in an inner surface of the holder over a substantially whole length thereof, so that the upper and lower contact portions projected from the holder are precisely regulated by the holder. In particular, this is true of the upper contact portion kept free during turning-off of the switch. Thus, the present invention permits the upper and lower contact portions to be uniformly projected without any scattering depending on the push switch.

More particularly, the sideway U-shaped spring element per se is manufactured by subjecting a metal leaf spring to pressing or bending, so that it would be considered that scattering occurs particularly in configuration depending on the spring element. However, once the sideway U-shaped spring element is fitted in the holder to assemble the contact spring element, the scattering depending on the U-shaped spring element can be completely eliminated for the reason described above.

This indicates that arrangement of the contact spring element in the casing for constructing the push switch of the present invention permits the lower contact portion to be inflectedly pressedly contacted with the one fixed contact at constant force and the distance d between the upper contact portion and the other fixed contact to be constant irrespective of the push switch. Thus, it will be noted that the push switch constantly exhibits satisfactory switching performance with high accuracy, because the pressing means ensures that the upper contact portion is downwardly moved by the predetermined distance d, resulting in being positively contacted with the one fixed contact to turn on the push switch.

Also, the push switch of the present invention is constructed in the manner that the sideway U-shaped spring element made of a leaf spring material by bending and provided with the upper and lower contact portions is integrally fitted in the holder provided with the pressing means, support shaft and recess, resulting in providing the contact spring element, which is then housed, in the casing provided with the fixed contacts. Thus, the push switch is simplified in structure, exhibits sufficient rigidity, is decreased in manufacturing cost and is rendered suitable for mass production. Further, a leaf spring which may be mass-produced by miniature precision-working can be used as the sideway U-shaped spring element, and the holder and casing can be automatically mass-produced from plastic resin by miniature precision-molding; therefore, the push switch of the present invention can be mass-produced with high precision and formed into a small size. Also, the push switch of the present invention is provided with sufficient durability and switching performance.

Further, the push switch of the present invention is so constructed that the contact spring element is pivotally supported on the support shaft. Such construction permits pressing force applied to the pressing means to downwardly pivotally move the distal end or upper and lower contact portions of the lower section, to thereby ensure that pressed inflection of the lower contact and pressed contact of the upper contact portion with the fixed contact are accurately attained. Also, it permits the distal end of each of the contact portions to be slid on the fixed contact while being pressedly contacted therewith, so that self-cleaning of the contacts may be carried out, to thereby ensure satisfactory switching performance.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

We claim:

1. A push switch comprising:

a sideway U-shaped spring element including an upper section, an inflected section and a lower section, said lower section being divided into an upper contact portion and a lower contact portion having a length larger than said upper contact portion;

a holder including an upper plate, a sideway U-shaped section and a lower plate and provided at a center thereof with a support shaft;

said upper plate being provided on a distal end thereof with a pressing means which functions to pressedly pivotally move said holder about said support shaft when force is applied thereto;

said upper plate, sideway U-shaped section and lower plate having an inner surface which includes a sideway U-shaped fit recess which extends around said support shaft;

said sideway U-shaped spring element begin fitted in said fit recess of said holder while inwardly forcing said upper section and lower section of said spring element, resulting in said holder and sideway U-shaped spring element cooperating with each other to constitute a contact spring element; and a casing for housing said contact spring element;

said contact spring element begin pivotally supported through said support shaft in said casing while inflectedly pressedly contacting said lower contact portion with a first fixed contact and striking said upper plate of said holder against a stopper to stop upward pivotal movement of said holder sue to restoring force of said spring element;

said upper contact portion being positioned at a predetermined distance above a second fixed contact.

2. A push switch as defined in claim 1, wherein said lower section of said U-shaped spring element is formed with a U-shaped slit, resulting in said upper contact portion being formed into a strip-like shape and positioned at a central portion of said lower section.

3. A push switch as defined in claim 1, wherein said sideway U-shaped spring element comprises a first sideway U-shaped spring element member in which a distal end of said lower section serves as said upper contact portion and a second sideway U-shaped spring element member which is formed into a length larger than said first spring element member and of which a distal end of said lower section serves as said lower contact portion;

said first and second spring element members being fittedly superposed on each other so as to permit said upper contact portion to be positioned above said lower contact portion.

4. A push switch as defined in claim 1, wherein said pressing means comprises a pressing element integrally provided on a distal end of said upper plate so as to be upwardly projected therefrom.

5. A push switch as defined in claim 1, wherein said fixed contacts are provided on an inner bottom surface of said casing and include terminals outwardly projected from said casing, respectively;

said casing includes a top plate formed with a slit through which said pressing means is outwardly projected;

said casing is provided on inner side surfaces thereof opposite to each other with recesses in which both ends of said support shaft are fitted;

said contact spring element is arranged in said casing in such a manner that said support shaft is born in said recesses, said pressing means is arranged so as to be upwardly projected from said slit, said lower contact portion is kept pressedly contacted with said first fixed contact and said upper contact portion is positioned above said second fixed contact; and said top plate is securely fixed on said casing by securely fitting projections formed on opposite outer side surfaces of said casing in holes of downwardly extending plates provided on opposite ends of said top plate, so that a rear surface of said top plate may act as a stopper for receiving upward pivotal moment of said holder due to pressed contacting of said lower contact portion with said one fixed contact and preventing said contact spring element from disconnecting from said casing.

6. A push switch as defined in claim 1, wherein said pressing means comprises a push button separately provided on a distal end of said upper plate so as to be upwardly projected therefrom.

* * * * *